United States Patent [19]

van Oorschot et al.

[11] 4,289,461

[45] Sep. 15, 1981

[54] LIQUID INJECTED COMPRESSOR WITH TEMPERATURE CONTROL OF LIQUID

[75] Inventors: Gosewinus F. van Oorschot, Breda, Netherlands; Kaj B. I. Emanuelsson, Edegem, Belgium

[73] Assignee: Atlas Copco Aktiebolag, Nacka, Sweden

[21] Appl. No.: 55,952

[22] Filed: Jul. 9, 1979

[30] Foreign Application Priority Data

Jul. 11, 1978 [SE] Sweden ..... 7807707

[51] Int. Cl.[3] ..... F04C 29/04

[52] U.S. Cl. ..... 418/84; 418/85; 418/87; 418/97; 418/DIG. 1

[58] Field of Search ..... 418/84, 85, 87, 97, 418/100, DIG. 1; 417/228, 438

[56] References Cited

U.S. PATENT DOCUMENTS

| | | | |
|---|---|---|---|
| 3,747,404 | 7/1973 | Novak | 73/168 |
| 3,759,348 | 9/1973 | Kasahara | 418/99 |
| 3,785,755 | 1/1974 | Novak et al. | 418/85 |
| 3,820,350 | 6/1974 | Brandin et al. | 62/193 |
| 4,035,114 | 7/1977 | Sato | 418/84 |

FOREIGN PATENT DOCUMENTS

| | | | |
|---|---|---|---|
| 2715610 | 10/1977 | Fed. Rep. of Germany | 418/85 |
| 2198104 | 3/1974 | France . | |
| 2299536 | 8/1976 | France . | |
| 2306349 | 10/1976 | France . | |
| 1349317 | 4/1974 | United Kingdom . | |

*Primary Examiner*—John J. Vrablik
*Attorney, Agent, or Firm*—Eric Y. Munson

[57] ABSTRACT

A liquid-injected compressor device for avoiding condensation of moisture in the outlet of a compressor is disclosed. The device comprises a control valve which is actuated in opposite directions by two sensors. One of the sensors senses the inlet temperature of the compressor and the other the outlet temperature. A constant temperature difference is maintained between the inlet and outlet of the compressor.

8 Claims, 8 Drawing Figures

LIQUID INJECTED COMPRESSOR WITH TEMPERATURE CONTROL OF LIQUID

The present invention relates to a liquid-injected compressor device for avoiding condensation in the outlet of the compressor.

In liquid-injected compressors liquid, normally oil, is injected into the compression chamber in order to cool the working medium, to lubricate the moving parts and to decrease the leakage. Since the injected liquid after the compression is separated from the compressed working medium and returned to the compressor for renewed injection it is essential to prevent that moisture present in the working medium is condensated before the liquid has been separated. If this is not prevented the injected liquid will contain more and more water as the compression process goes on.

A prior art solution of this problem uses a liquid cooler provided with a shunt conduit and a thermostatic valve in the shunt conduit. This gives a substantially constant temperature of the compressed working medium. This temperature is preset on the thermostatic valve. In order to avoid condensation at higher ambient temperatures and high humidity this temperature must be chosen high, e.g. 85° C. This results in an unnecessarily low efficiency at normal or low ambient temperatures. Furthermore, the liquid will work in the neighbourhood of the maximum allowable temperature. As a result, if oil is used, the oil will be rapidly oxidized so that it must be replaced with short intervals.

The above mentioned problems are avoided by the present invention by using a control valve unit provided with two sensors. One of the sensors senses the condition of the working medium at the inlet of the compressor and the other a condition which stands in a predetermined relation to the condition of the compressed working medium at the outlet of the compressor. This means that the second sensor senses either the condition of the working medium after the liquid separator of the condition at the outlet of the compressor element or the temperature of the injected liquid. The last mentioned alternative can be used if the regulation of the cooling of the working medium does not change the amount of injected liquid. The condition of the working medium should be understood as its temperature, the dew point or the wet temperature. Since the temperature rise during compression and the temperature decrease between the outlet of the compressor and the outlet of the liquid separator are known for a given compressor assembly the control valve unit can be modified with these temperature changes in mind so that condensation is avoided until the liquid has been separated.

Some embodiments of the invention will be described below with reference to the accompanying drawings in which FIG. 1 shows the invention with regulation of the amount of injected liquid.

Figure 1:
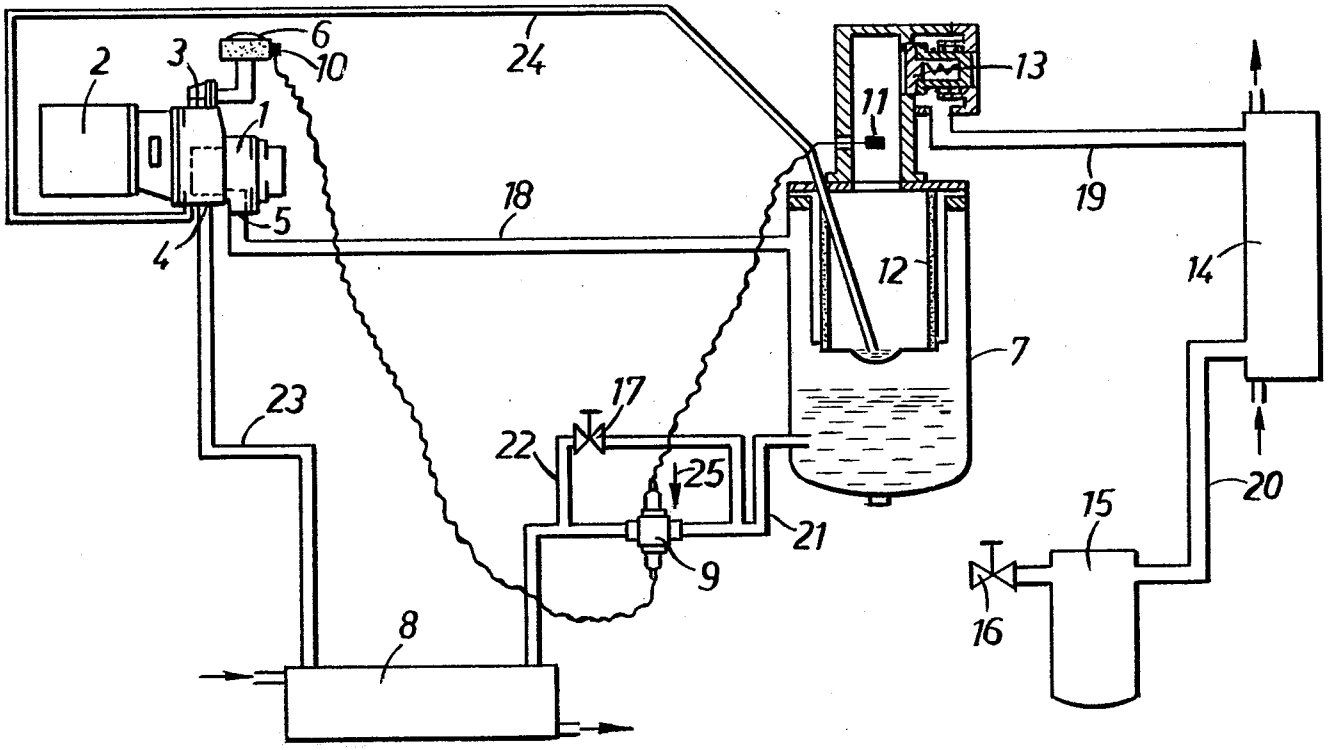

The compressor device shown in FIG. 1 comprises a compressor 1 driven by a motor 2. Working medium is supplied to the first inlet 3 of compressor 1 via an air filter 6. The compressor is furthermore provided with a second inlet 4 for injection of liquid into the compression chamber of the compressor, and an outlet 5 for compressed working medium. The compressed working medium is conducted via a conduit 18 to a liquid separator 7 where the main part of the liquid is separated by centrifugal action in the container 7 and collected on its bottom. The liquid separator 7 comprises a filter unit 12 in which substantially all the remaining liquid is separated and collected on the bottom. The working medium, freed from injection liquid, is then conducted via a minimum pressure valve 13, a conduit 19, an aftercooler 14, a conduit 20, a container 15 and a valve 16 to different consumers. The liquid collected on the bottom of the filter unit 12 is conducted back to the compressor 1 via conduit 23 by the pressure in the filter unit. The injection liquid is conducted from container 7 via conduit 21, control valve 9, liquid cooler 8 and conduit 23 to the compressor 1 for injection into its compression chamber. The shunt conduit 22 is provided with an adjustable valve 17 by means of which a minimum flow of injection liquid can be preset. The device according to FIG. 1 is provided with a first sensor 10 for sensing the temperature of the working medium in the air filter 6. This sensor is connected to the control valve 9 such that a temperature increase in the air filter 6 causes a decrease of the flow through valve 9. Arrow 25 shows the direction in which valve 9 opens. Furthermore there is a second sensor 11 which senses the temperature of the working medium after the liquid separation and which is connected to the control valve 9 such that a temperature increase causes an increase of the flow through valve 9. The two sensors thus actuate valve 9 in opposite directions.

Figure 2:
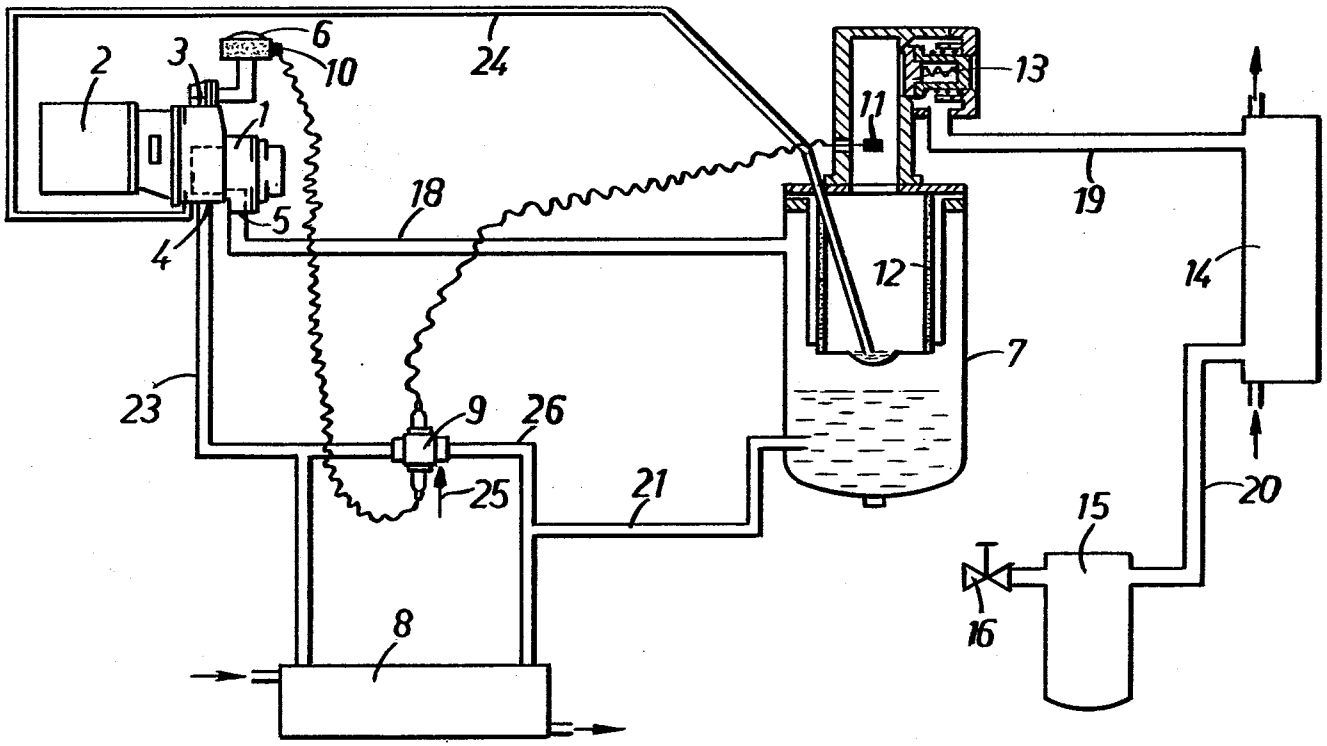
FIG. 2 shows an embodiment with shunt regulation of the injected liquid.

The compressor device according to FIG. 2 differs from the one according to FIG. 1 in that the control valve 9 is placed in a shunt conduit 26 bypassing the liquid cooler 8. As a consequence the first sensor 10 is connected to valve 9 such that a temperature increase in the air filter 6 causes an increase of the flow through valve 9. The second sensor 11 actuates valve 9 in the opposite direction also in this case.

Figure 3:
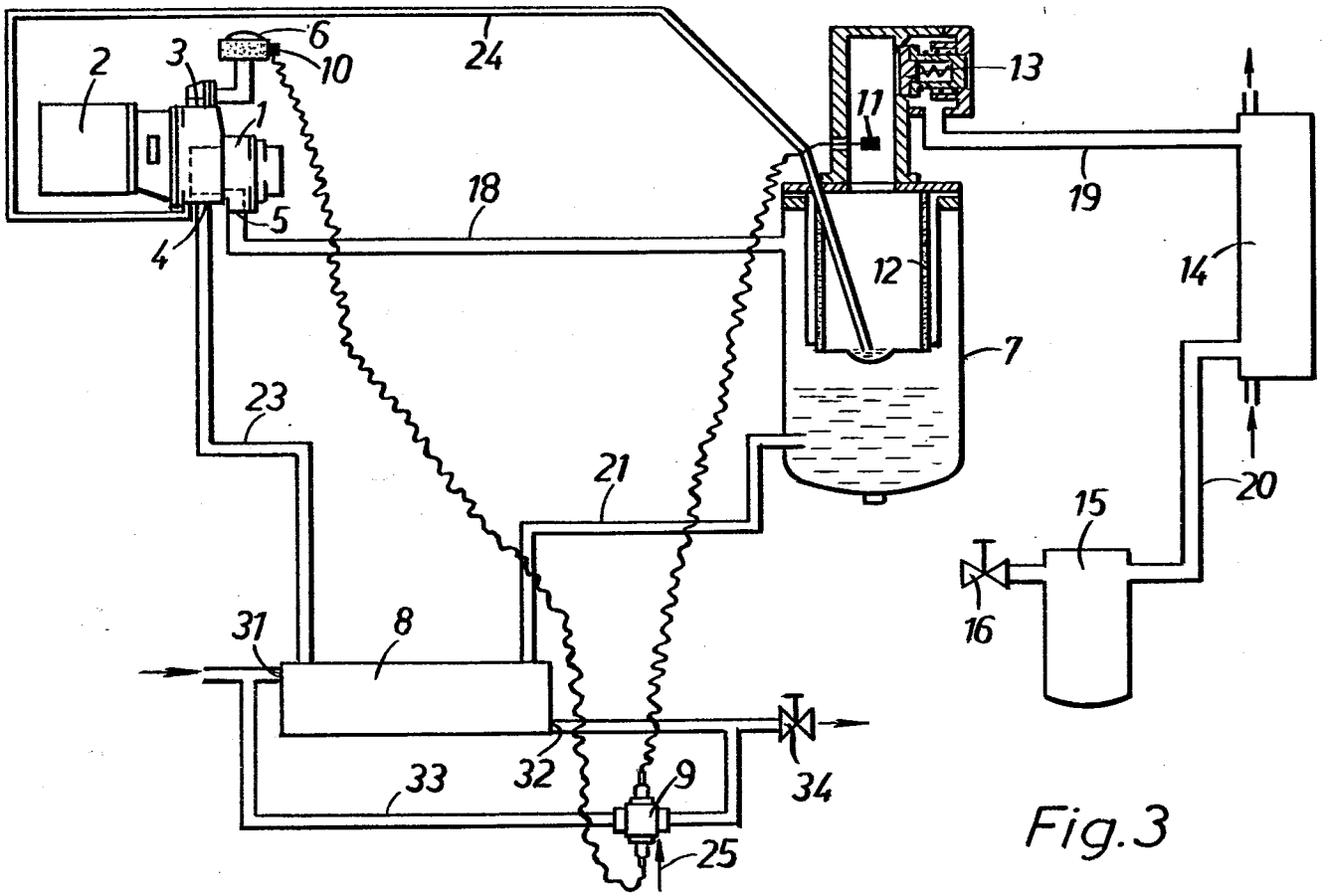
FIG. 3 shows an embodiment with shunt regulation of the cooling water.

In the device according to FIG. 3 the cooling of the injection liquid is regulated in that the control valve 9 is placed in a shunt conduit 33 which connects the cooling water inlet 31 of the liquid cooler 8 to the cooling water outlet 32. Furthermore, there is an adjustable valve 34 by means of which the total flow of cooling water can be preset. Also in this case the two sensors actuate the control valve 9 in opposite directions.

Figure 4:
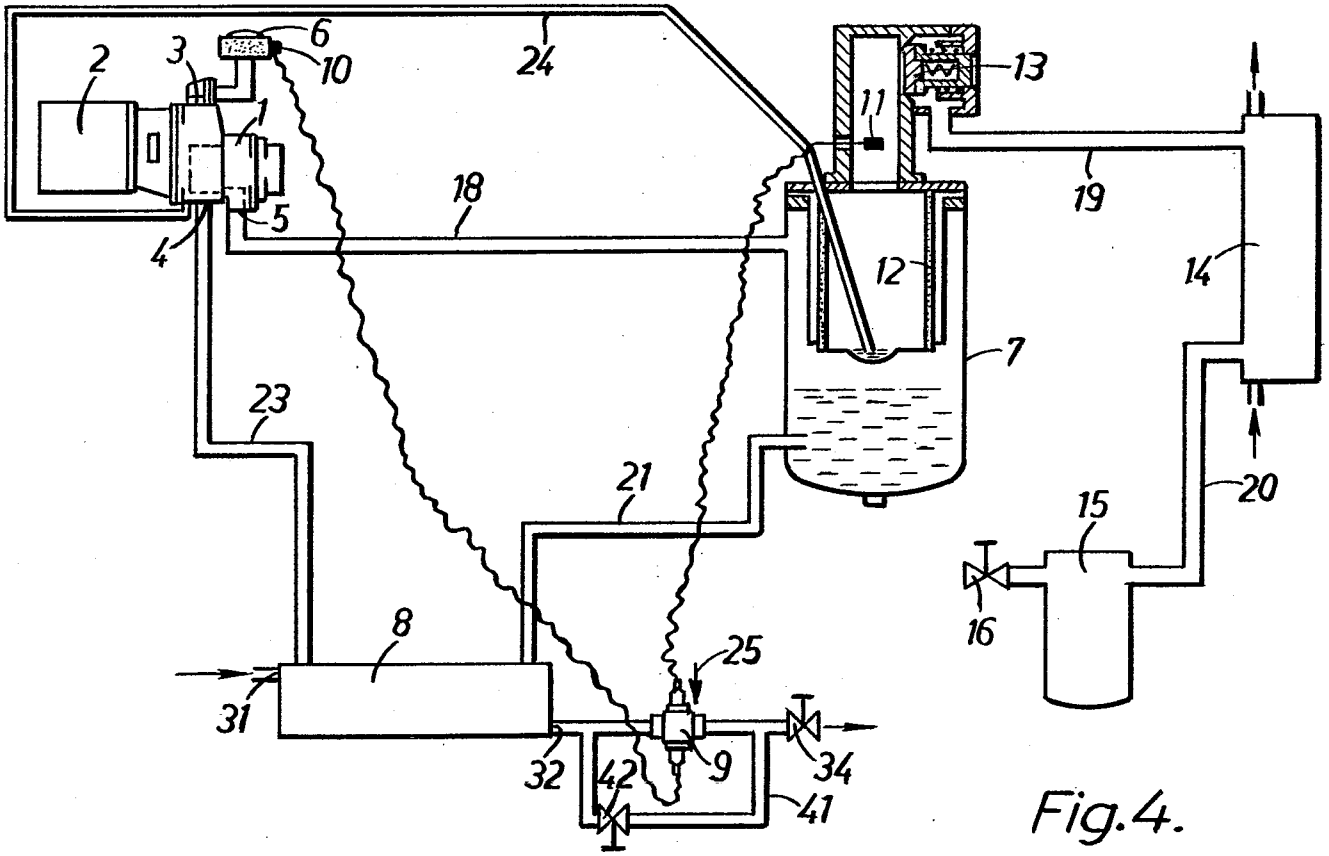
FIG. 4 shows an embodiment with regulation of the flow of cooling water.

In the embodiment according to FIG. 4 the control valve 9 is placed in the conduit between the cooling water outlet 32 of the liquid cooler 8 and valve 34 and provided with a shunt conduit 41 in which a valve 42 is mounted. A minimum flow of cooling water is preset by valve 42.

Figure 5:
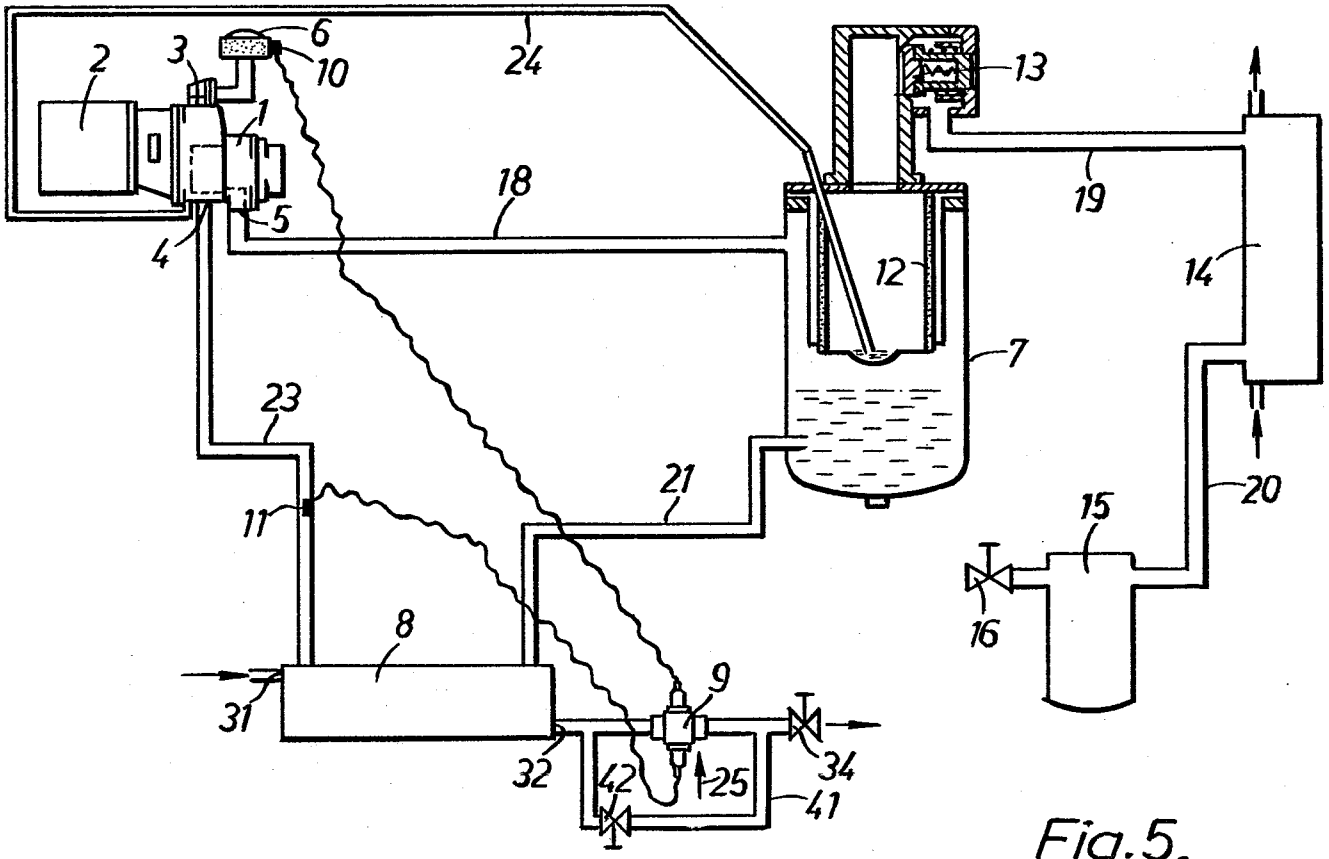
FIG. 5 shows an embodiment similar to that according to FIG. 4 but with sensing of the temperature of the injected liquid.

The embodiment according to FIG. 5 differs from the embodiment according to FIG. 4 only therein that the second sensor 11 is placed in conduit 23 to sense the temperature of the injection liquid.

Figure 6:
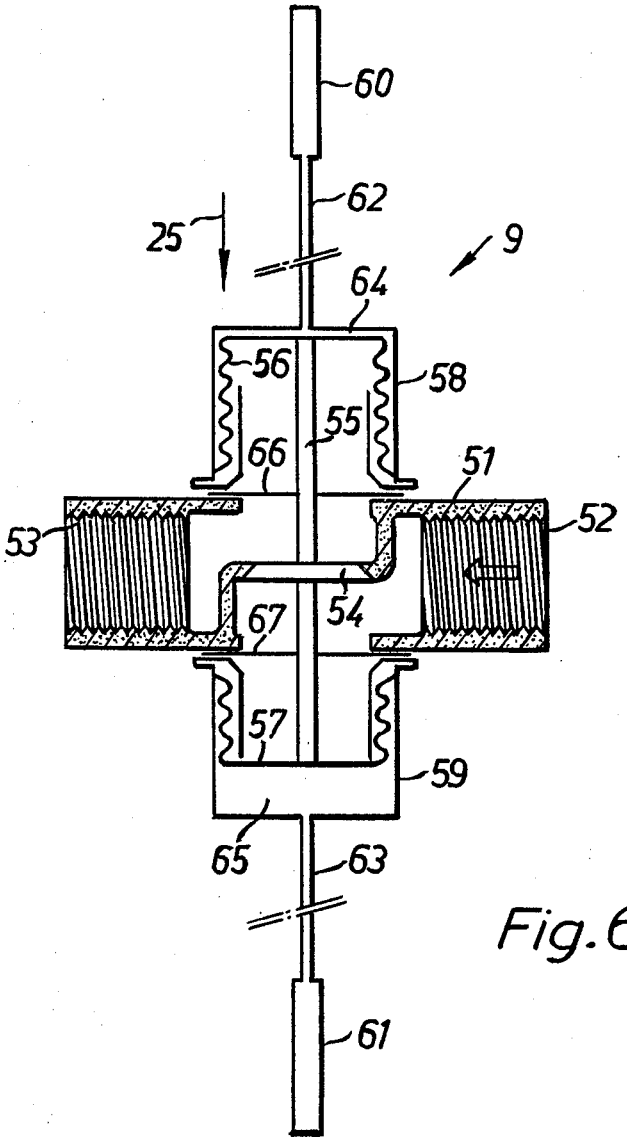
FIG. 6 shows the control valve of FIGS. 1-5.

FIG. 6 shows the design of the control valve 9 used in the embodiments according to FIGS. 1–5. Valve 9 comprises a valve housing 51 provided with an inlet 52 and an outlet 53. The flow through valve 9 is controlled by a valve disc 54 which is actuated by a rod 55. Rod 55 is actuated by two bellows 56, 57. These bellows are together with the membranes 66, 67 and the caps 58, 59 mounted on the housing 51 in a suitable way. There are two rooms 64, 65 enclosed between the bellows and the caps. These rooms, the conduits 62, 63 and the sensors 60, 61 are filled with a material having a high temperature modulus. By filling the rooms 64, 65 with suitable amounts of material during manufacturing the valve will open at a predetermined temperature difference between the sensors 60, 61. The bellows are in this way prestressed as desired. The sensors have in FIG. 6 been designated 60, 61 instead of 10, 11 because there is no unique correspondence. When comparing FIG. 6 with the other figures the direction of arrow 25, which shows the direction in which valve 9 opens, must be considered.

Figure 7:
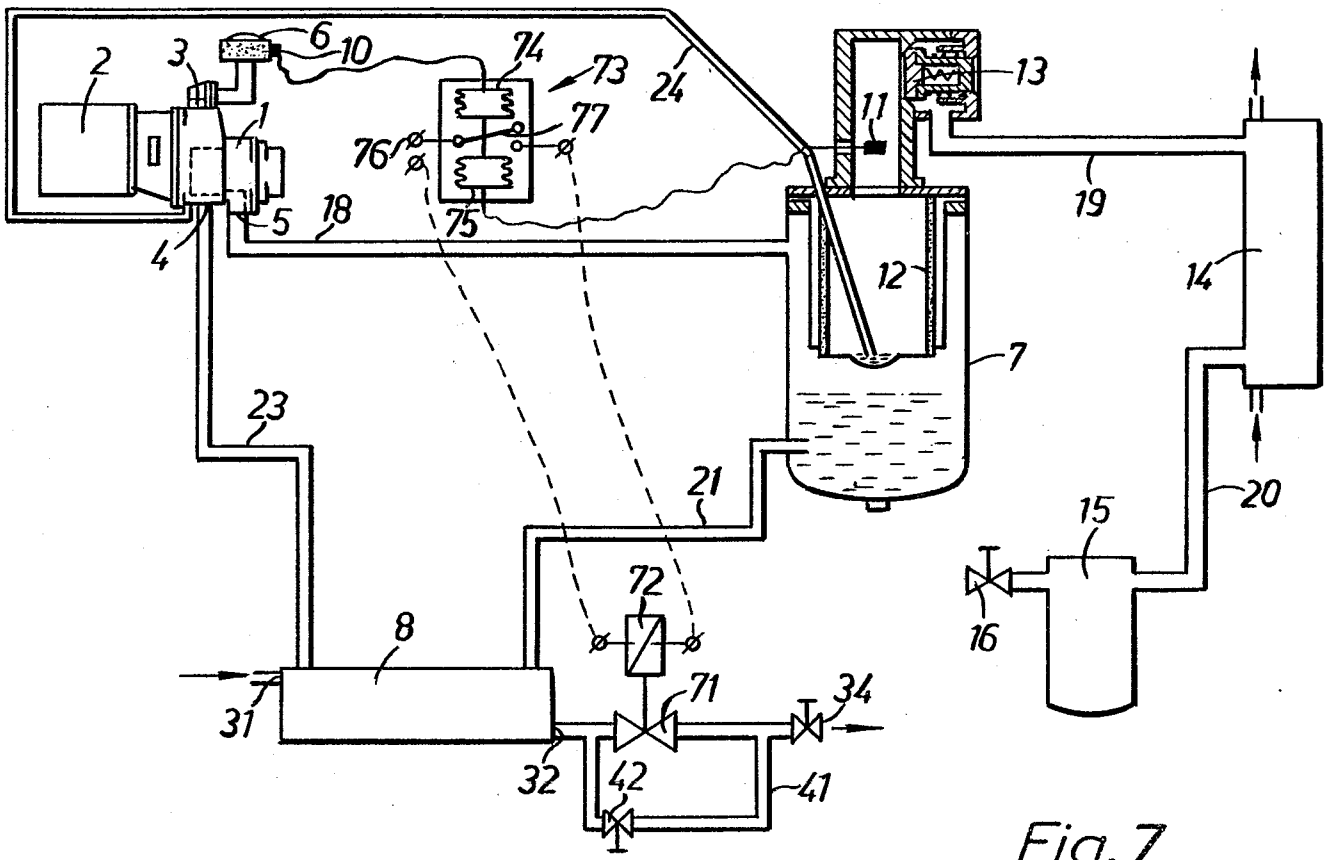
FIG. 7 shows an embodiment with electrically controlled valve.

The device according to FIG. 7 differs from the device according to FIG. 4 in that the control valve 9 has been replaced by a control valve unit comprising a valve 71, an actuator 72 and a control unit 73. Valve 71 is normally held open by a not shown spring which can be mounted either in valve 71 or in the actuator 72. Actuator 72 comprises a solenoid which closes valve 71 when the control unit 73 supplies a voltage to the actuator. The control unit 73 comprises two bellows 74, 75 which actuate a switch 77 in opposite directions. The control unit 73 is connected to a power supply 76. The control valve unit shown in FIG. 7 is of the simplest design and will during operation regulate the cooling by alternatively opening and closing valve 71. Alternatively the regulation can be made continuous by providing the actuator 72 with a servomotor which drives the valve in both directions. The control unit must then be modified so that voltage can be supplied to either of two conduits in order to drive the servomotor in one direction or the other. This can be achieved by replacing switch 77 with a switch having an open centre position and two closed end positions.

Figure 8:
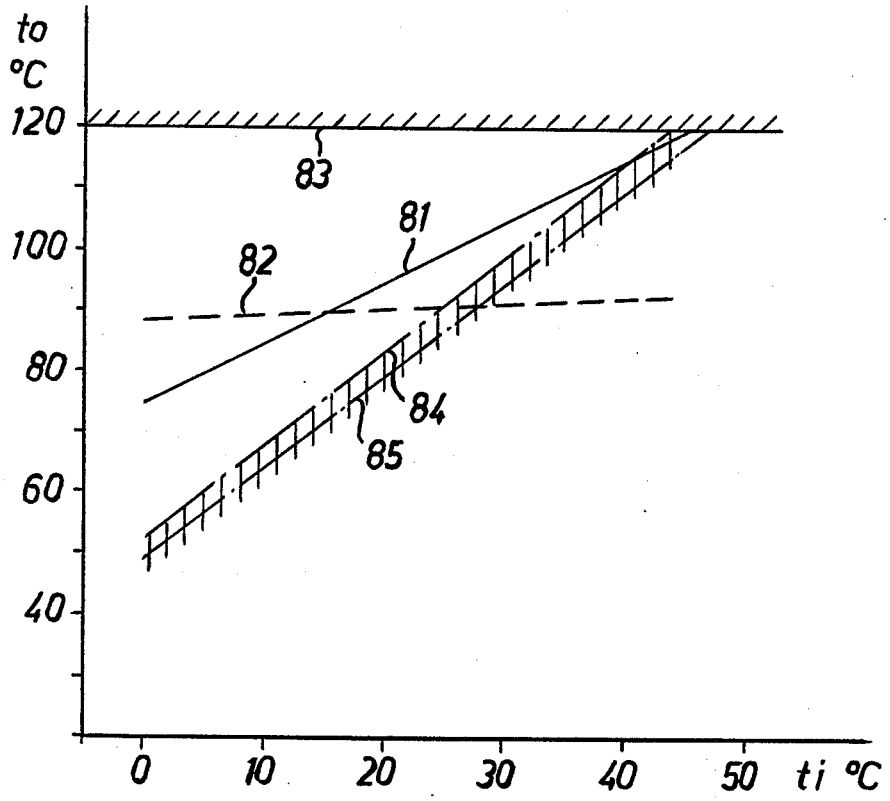
FIG. 8 shows in diagram form how the outlet temperature varies with the inlet temperature in a device according to the invention as well as in a prior art device.

FIG. 8 shows in diagram form a comparison between the present invention and prior art. The diagram relates to compression from atmospheric pressure to 20 bar. Curve 81 shows how the outlet temperature to varies with the inlet temperature ti according to the present invention. Curve 82 shows how the outlet temperature varies according to prior art when the outlet temperature has been preset to a value 75° C. higher than the inlet temperature for an inlet temperature of 15° C. Curve 83 shows the highest allowable temperature for the injected oil. This temperature must not be exceeded anywhere in the system. In order to increase the service life of the oil and to improve the efficiency of the compressor the temperature should be as far below this limit temperature as possible. Curve 84 shows the boundary for condensation at a relative humidity of 100% in the ambient atmosphere. Curve 85 relates to a relative humidity of 85%. As can be seen in FIG. 8 it is possible to operate according to the present invention over a large temperature interval with good efficiency and without risk for condensation. This interval is with regulation according to prior art considerably narrower so that the outlet temperature must be adjusted when the inlet temperature varies if decreased efficiency and condensation are to be avoided.

We claim:

1. A liquid-injected compressor device for avoiding condensation in the outlet of the compressor, comprising a compressor (1) provided with a first inlet (3) for working medium, a second inlet (4) for injection of liquid for cooling the working medium and an outlet (5) for compressed working medium, a liquid separator (7) connected to said outlet (5) and a liquid cooler (8) connected to said liquid separator (7) and to said second inlet (4) characterized by a control valve unit (9 or 71,72,73) provided with two sensors (10,11) for regulation of said cooling, whereby one of the sensors (10) is arranged for sensing the condition of the working medium at said first inlet (3) and the other sensor (11) is arranged for sensing a condition which stands in a predetermined relation to the condition of the compressed working medium at said outlet (5) and that said sensors (10,11) are arranged to actuate the control valve unit (9 or 71,72,73) in opposite directions.

2. A device according to claim 1, characterized thereby that the first sensor (10) is arranged to actuate the control valve unit (9 or 71,72,73) such that a temperature increase in said first inlet (3) causes a decrease of said cooling.

3. A device according to claim 1 or 2, characterized thereby that the control valve unit (9) is arranged in a conduit (21) which connects the liquid separator (7) to the liquid cooler (8).

4. A device according to claim 1 or 2, characterized thereby that the control valve unit (9) is arranged in a conduit (26) which connects the inlet of the liquid cooler (8) to its outlet.

5. A device according to claim 1 or 2, whereby the liquid cooler (8) is water-cooled, characterized thereby that the control valve unit (9) is arranged in a conduit (33) which connects the water inlet (31) of the liquid cooler (8) to its water outlet (32).

6. A device according to claim 1 or 2, whereby the liquid cooler (8) is water-cooled, characterized thereby that the control valve unit (9 or 71,72,73) is arranged in a conduit which conducts cooling water through the liquid cooler (8).

7. A device according to claim 1, characterized thereby that said second sensor (11) is arranged to sense the temperature of the injected liquid.

8. A device according to claim 1, characterized thereby that the control valve unit comprises a control valve (9) which is actuated directly by said sensors (10,11).

* * * * *